United States Patent [19]

Weiss et al.

[11] Patent Number: 4,687,043

[45] Date of Patent: Aug. 18, 1987

[54] COMPOSITE CASTING PROCESS

[75] Inventors: Franz Weiss, Neckarsulm; Dieter Eschenweck, Mosbach; Manfred Stark, Neckarsulm, all of Fed. Rep. of Germany

[73] Assignee: Kolbenschmidt Aktiengesellschaft, Neckarsulm, Fed. Rep. of Germany

[21] Appl. No.: 840,803

[22] Filed: Mar. 18, 1986

[30] Foreign Application Priority Data

Mar. 29, 1985 [DE] Fed. Rep. of Germany ..... 3511542

[51] Int. Cl.[4] ..... B22D 19/14

[52] U.S. Cl. ..... 164/97; 164/100; 164/102

[58] Field of Search ..... 164/75, 97, 98, 100, 164/102; 29/419 R

[56] References Cited

FOREIGN PATENT DOCUMENTS 141121 4/1980 Fed. Rep. of Germany ..... 164/102

57-177873 11/1982 Japan ..... 164/100

*Primary Examiner*—Nicholas P. Godici

*Assistant Examiner*—Richard K. Seidel

*Attorney, Agent, or Firm*—Sprung, Horn, Kramer & Woods

[57] ABSTRACT

In a composite casting process for making aluminum alloy components for internal combustion engines, which components are provided at highly loaded surfaces with shaped elements which consist of fibers or whiskers and are bonded to the castings, the shaped elements consisting of fibers of whiskers are infiltrated with an aluminum alloy which has a higher melting point than the aluminum alloy of the casting. The infiltration is effected in such a manner that the infiltrated aluminum alloy forms a cover layer on the shaped element. In order to ensure the formation of a bond between the casting and the shaped element as the aluminum alloy for making the casting is cast in contact with the shaped element, the infiltrated shaped elements are dipped into a molten solder alloy before the aluminum alloy for making the casting is cast in contact with the shaped element, and the latter is subsequently placed into the heated mold for making the casting, whereafter the casting is made.

6 Claims, No Drawings

COMPOSITE CASTING PROCESS

BACKGROUND OF THE INVENTION

This invention relates to a composite casting process for manufacturing components which comprise castings of silicon-containing aluminum alloys and are intended to define the combustion chamber of internal combustion engines, and shaped elements, which are bonded to the castings at surfaces to be subjected to high thermal and/or mechanical loads and consist of inorganic nonwoven fibers or whiskers and have a fiber or whisker volume of 10 to 50% and have been infiltrated with an aluminum alloy which has a melting point that is higher, preferably by 30° to 140° C., than the melting point of the aluminum alloy of the casting, which infiltration is effected under a pressure which is maintained until said infiltrating aluminum alloy has solidified and in such a manner that the infiltrating aluminum alloy forms on the shaped element a cover layer in the regions in which the shaped elements are to be bonded to the casting.

In a composite casting process for manufacturing fiber-reinforced components of internal combustion engines, such as pistons and cylinders, the infiltrating metal is permitted to solidify under an elevated pressure so that a fiber-reinforced shaped element is obtained in a first process step and that shaped element is then placed in a predetermined position into the mold for making the casting and is bonded to the casting by a low-pressure casting process in which molten material is used which is at a temperature above the melting point of the cover layer and below the melting point of the core region of the shaped element (German Patent Specification No. 27 01 421).

A disadvantage of that composite casting process resides in that the casting of the aluminum alloy in contact with the shaped element which comprises a cover layer consisting of an aluminum alloy is rendered very difficult by the presence of oxides on the cover layer so that the formation of a bond between the cover layer and the aluminum layer of the casting throughout their interface is adversely affected or may be inhibited in numerous cases.

SUMMARY OF THE INVENTION

It is an object of the invention to improve the composite casting process of the kind described first hereinbefore, so that a bond between the cover layer and the casting is obtained throughout their interface when the aluminum alloy for forming the component is cast in contact with the cover layer of the shaped element.

That object is accomplished in that the shaped elements which have been infiltrated with a wrought aluminum alloy and provided with a cover layer consisting of the wrought aluminum alloy are dipped into a molten solder alloy having a melting temperature between 150° and 400° C. and are thus provided with a molten layer consisting of the solder alloy and are subsequently placed in a predetermined position in the heated casting mold for making the casting, which is then cast in said mold. That measure ensures that the oxides will be separated from the cover layer and a formation of new oxides will be prevented. During the casting of the aluminum alloy for making the casting, the solder alloy layer is entirely flushed from the cover layer so that a bond between the cover layer of the shaped element and the aluminum layer of the casting is obtained throughout their interface. When the shaped element has been placed into the mold, which is at a temperature of 250° to 400° C., the solder alloy layer remains in a molten state.

The cover layer of the shaped element suitably has a thickness of 1 to 5 mm.

It will be sufficient, as a rule, to dip the shaped elements into the molten bath of the solder alloy for 30 to 90 seconds.

It may be desirable to brush the solder alloy layer before the aluminum alloy for making the casting or to subject the shaped elements dipped into the molten alloy to an ultrasonic treatment so that any oxide particles present on the surface of the cover layer will be removed.

It has been found that the molten solder alloy may most suitably consist of a zinc solder alloy which contains tin and cadminum in order to reduce the melting temperature of the solder alloy below the temperature of the casting mold. The zinc solder alloys suitably contain 10 to 30 wt. % tin and 5 to 25 wt. % cadmium.

The process in accordance with the invention has provided most satisfactory for bonding shaped elements having the shaped structure in those regions of the pistons of internal combustion engines which are subjected to particularly high stresses. Such regions are the rim of the combustion chamber recess, the ring zone, the piston head, and the piston pin bosses.

In order to assist in the removal of the oxide particles from the cover layer of the shaped elements, it is desirable within the scope of the invention to design that surface of the cover layer of the shaped element which is to be contacted with the molten aluminum layer used to make the casting, so that a laminar flow will be obtained in the aluminum alloy for making the casting as said aluminum alloy is cast in contact with said surface.

The invention will now be explained more in detail with reference to two examples.

FIRST EXAMPLE

The rim of the combustion chamber recess of a diesel engine piston consisting of an aluminum alloy of the type AlSi12CuNiMg is to be protected from thermal fatigue. To that end, an annular shaped element consisting of $Al_2O_3$ fibers and having a fiber volume of 20% is infiltrated under a pressure of about 1000 bars with a wrought aluminum alloy of the type AlCu4Ni2Mg. That infiltration is effected in such a manner that a cover layer consisting of the wrought aluminum alloy and having a thickness of 1 to 2 mm is formed in those regions in which the shaped element is to be contacted by the aluminum alloy of the piston. The shaped element is dipped into a molten bath of a zinc solder alloy of the type ZnSn18Cd12. That bath is at a temperature of 500° C. As a result, a thin layer of the solder alloy is formed on the cover layer of the shaped element. The shaped element provided with the molten solder alloy layer is then placed in a suitable position into the casting mold, which has been heated to 400° C. Thereafter the piston aluminum alloy is cast at a temperature of 780° C. in contact with said shaped element by gravity casting. Owing to the convection taking place as the casting mold is filled, the zinc solder alloy layer is entirely flushed from the cover layer of the shaped element so that a bond is obtained between the cover layer and the piston aluminum layer.

SECOND EXAMPLE

A cylinder head casting consisting of an aluminum alloy of the type AlSi8Cu3 and intended for use in a water-cooled four-cylinder, four-stroke-cycle engine, is to be reinforced in a portion which has the shape of a spherical cap for defining a combustion chamber. To that end, shaped elements consisting of SiC whiskers and having a whisker volume of 15% are infiltrated under a pressure of 1200 bars with a wrought aluminum alloy of the type AlCu4Ni2Mg. In those regions or the molded element in which the aluminum alloy for making the cylinder head is to be cast in contact with the shaped element, a cover layer consisting of the wrought aluminum alloy and having a thickness of 1.5 mm is formed on the surface of that shaped element. The cover layer is dipped into a suitable bath of a molten zinc solder alloy of the type ZnSn18Cd12 and is thus coated with a thin layer of the solder alloy. When the zinc solder alloy layer is still molten, the shaped element is inserted into the casting mold for making the cylinder head, which mold has been heated to 400° C. Thereafter the aluminum alloy for making the cylinder head is cast in contact with the shaped element in a low pressure casting process.

What is claimed is:

1. In a composite casting process for manufacturing components which comprise castings of silicon-containing aluminum alloys and are intended to define the combustion chamber of internal combustion engines, and shaped elements, which are bonded to the castings at surfaces to be subjected to high thermal and/or mechanical loads and consist of inorganic non-woven fibers or whiskers and have a fiber or whisker volume of 10 to 50% and have been infiltrated with an aluminum alloy which has a melting point that is higher, preferably by 30° to 140° C., than the melting point of the aluminum alloy of the casting, which infiltration is effected under a pressure which is maintained until said infiltrating aluminum alloy has solidified and in such a manner that the infiltrating aluminum alloy forms on the shaped element a cover layer in the regions in which the shaped elements are to be bonded to the casting, the improvement comprising: dipping the shaped elements, which have been infiltrated with a wrought aluminum alloy and provided with a cover layer consisting of the wrought aluminum alloy, into a molded solder alloy having a melting temperature between 150° and 400° C. to provide a molten layer consisting of the solder alloy; and subsequently placing the dipped elements in a predetermined position in the heated casting mold to maintain the solder alloy in the molten state; and then casting in said mold.

2. A composite casting process according to claim 1, wherein the cover layer has a thickness of 1 to 5 mm.

3. A composite casting process according to claim 1 or 2, wherein the shaped element is dipped into the molten solder alloy for 30 to 90 seconds.

4. A composite casting process according to claim 1, wherein the molten solder alloy layer on the cover layer of the shaped element is brushed before the aluminum alloy for making the component is cast in contact with the shaped element.

5. A composite casting process according to claim 1, wherein the shaped element is ultrasonically treated when it is immersed in the molten solder alloy.

6. A composite casting process according to claim 1, wherein a zinc solder alloy is used which contains 10 to 30 wt. % tin and 5 to 25 wt. % cadmium.

* * * * *